United States Patent [19]

Götz

[11] Patent Number: 5,018,949

[45] Date of Patent: May 28, 1991

[54] DIAPHRAGM PUMP

[75] Inventor: Hans Götz, Bad Urach, Fed. Rep. of Germany

[73] Assignee: Uraca Pumpenfabrik GmbH & Co. KG, Bad Urach, Fed. Rep. of Germany

[21] Appl. No.: 473,162

[22] Filed: Jan. 31, 1990

[30] Foreign Application Priority Data

Feb. 2, 1989 [DE] Fed. Rep. of Germany ..... 39030490

[51] Int. Cl.[5] ..... F04B 27/08; F04B 43/06

[52] U.S. Cl. ..... 417/339; 417/395; 417/539

[58] Field of Search ..... 417/383–389, 417/395, 539, 339

[56] References Cited

U.S. PATENT DOCUMENTS 2,624,284 1/1953 Straub ..... 417/339
4,705,461 11/1987 Clements ..... 417/388
4,790,732 12/1988 Yamatani ..... 417/539
4,830,589 5/1989 Pareja ..... 417/539

*Primary Examiner*—Leonard E. Smith
*Assistant Examiner*—Eugene L. Szczecina, Jr.
*Attorney, Agent, or Firm*—Evenson, Wands, Edwards, Lehanan & McKeown

[57] ABSTRACT

The pump has several cylinders which are arranged in a row narrowly adjacent to one another and which accommodate the stroke working spaces of plungers or pistons. The stroke work of the pistons is hydraulically transmitted to diaphragms which close off pump working spaces inside of diaphragm working spaces in the direction of the cylinders. Because of the arrangement of the diaphragm working spaces or of the pump working spaces on different sides of the cylinder block, diaphragms or diaphragm working spaces may be arranged which have cross-sections that are large in comparison to the distance of the cylinders from one another.

11 Claims, 1 Drawing Sheet

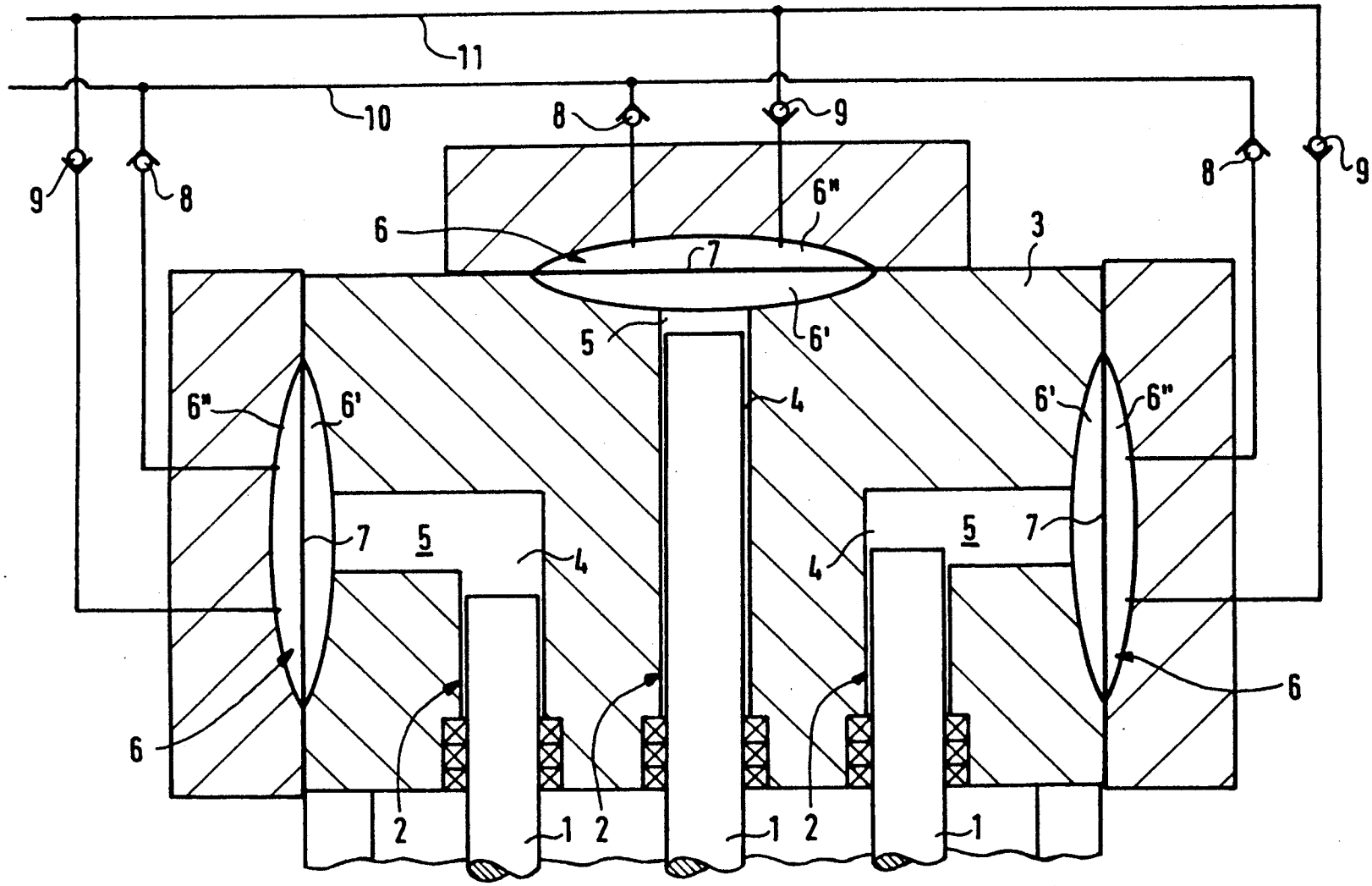
9
8
6
6"
6'
7
3
5
1
2
4
11
10

DIAPHRAGM PUMP

BACKGROUND AND SUMMARY OF THE INVENTION

The invention relates to a diaphragm pump having several cylinders which are arranged in a row and which each form the stroke working space of a piston or plunger as well as having pump working spaces arranged in the same number which each may be closed off, on the suction side, by an inlet valve arrangement and, on the pressure side, by an outlet valve arrangement and are separated by a diaphragm from the stroke working space of the assigned piston or plunger, the work of the piston or plunger being transmissible to the diaphragm by a transmission fluid received in the stroke working space.

Diaphragm pumps of this type are known. In this case, the pump working spaces are each arranged as an extension of the working spaces so that a constructively simple design is obtained of the connecting paths from the stroke working spaces to the respectively assigned diaphragms of the pump working spaces. The driving mechanism of the pistons or plungers of these known diaphragm pumps, in principle, corresponds to the driving mechanism of conventional piston or plunger pumps which operate without any diaphragms and in which therefore the stroke working spaces at the same time form the pump working spaces. Also, the manufacturing expenditures for these known diaphragm pumps are undesirably high. This is mainly based on the fact that the stroke working spaces or pump working spaces, in the area of the diaphragms, generally have very large cross-sections which are significantly larger than the cross-sections of the pistons or plungers. Correspondingly, the pump working spaces can be arranged as an extension of the respectively assigned stroke working spaces only if the distances between the cylinders are correspondingly large and thus are dimensioned very differently from those of conventional piston or plunger pumps without diaphragms. The result is that, up to now, special driving mechanisms had to be built for the pistons or plungers for the diaphragm pumps of the initially mentioned type; i.e., the driving mechanisms of conventional piston or plunger pumps without diaphragms could not be used.

It is an object of the invention to provide a diaphragm pump which can be manufactured at a particularly low price.

In the case of the initially mentioned diaphragm pumps, this object is achieved according to preferred embodiments of the invention in that the cylinders are arranged at distances which are narrow in comparison to the cross-section of the pump working spaces, and the pump working spaces are arranged on different sides of the row of cylinders or of a cylinder block receiving the cylinders.

The invention is based on the general idea that the pump working spaces may be arranged in a varied manner relative to the stroke working spaces. In particular, in addition to arranging the pump working space as an extension of the stroke working space, an arrangement laterally next to the stroke working space is also possible. Because of the fact that the pump working space assigned to adjacent stroke working spaces are arranged on different sides of the row of cylinders or of the cylinder block, even, in the case of narrow distances of the cylinders, sufficient space is available for the arrangement of the diaphragms. Thus, the invention moves away from the traditional construction of diaphragm pumps in which the pump working spaces and the stroke working spaces which are assigned to one another are in each case arranged in the same manner relative to one another. Even though the different arrangement of the pump working spaces relative to the stroke working spaces provided according to the invention results in certain additional manufacturing expenditures, the manufacturing costs of the diaphragm pump according to the invention, as a whole, remain comparatively low because the piston or plunger driving mechanism and thus particularly also the crank mechanism may remain unchanged in comparison to conventional piston or plunger pumps without any diaphragm. Thus, to a large extent, the diaphragm pump according to the invention can be manufactured by using industrial-scale parts of conventional pumps.

In the case of a three-cylinder pump, the pump working space assigned to the center cylinder is preferably arranged as an extension of the center cylinder, and the pump working spaces assigned to the other cylinders are preferably each arranged laterally of the cylinder axis, these two latter pump working spaces expediently each being situated as an extension of the row of cylinders.

This arrangement is possible in the same manner in the case of pumps with vertical cylinders as well as in the case of pumps with horizontally arranged cylinders.

Another advantage of the invention is the fact that basically diaphragms of any shape may be used; i.e., the invention is not limited to diaphragm pumps with a special diaphragm shape. For example, according to the invention diaphragm pumps are conceivable which have tubular diaphragms as well as those which have flat diaphrams.

Other objects, advantages and novel features of the present invention will become apparent from the following detailed description of the invention when considered in conjunction with the accompanying drawings.

BRIEF DESCRIPTION OF THE DRAWINGS

The single drawing figure is a sectional view shown as a cut-out of a three-cylinder diaphragm pump constructed according to a preferred embodiment of the invention, the cutting plane being formed by the plane formed by the cylinder axes.

DETAILED DESCRIPTION OF THE DRAWINGS

In a conventional manner, the pump according to the invention has a crank mechanism which is not shown and has a crank shaft and a connecting rod which connect the crankshaft throws, with respect to the drive, with linearly extending crossheads. The crossheads, in turn, in a known manner, are connected with pistons or plungers 1 which, in a manner which is known in principle, are guided in cylinders 2 so that they can carry out a stroke. The cylinders may be housed in a common cylinder block 3. Instead, it is also possible that the cylinder block 3 is divided into several partial blocks which each receive one cylinder 2. According to the rotating position of the crankshaft, i.e., depending on the stroke position, the plungers or pistons 1 project more or less far into their stroke working spaces 4 inside the cylinders 2.

By way of pipes 5, the stroke working spaces 4 are connected with the diaphragm working spaces 6 which, by means of one diaphragm 7 respectively which, in the shown embodiment, is flat and plate-shaped, are divided into a cylinder-side space 6' as well as a pump working space 6''. The pump working spaces 6'', by means of respective inlet and suction valve arrangements 8 shown only schematically, can be connected with the suction side or suction pipe 10 of the pump and, by means of an outlet or pressure valve arrangements 9, with the pressure side or pressure pipe 11 of the pump.

The stroke working spaces 4 as well as the pipes 5 and the connecting spaces 6' of the diaphragm working spaces 6 receive a hydraulic transmission medium which transmits the stroke work of the plungers or pistons 1 to the diaphragms 7. Correspondingly, the diaphragms 7, together with the plungers or pistons 1, carry out stroke motions, in which case the volume of the pump working spaces 6'' is increased during the suction stroke of the plungers or pistons 1 and is reduced during the pressure stroke of the pistons or plungers 1; i.e., during the suction stroke of a piston or plunger 1, pumping medium is taken into the assigned pump working space 6'' which, during the subsequent pressure stroke of the piston or plunger 1, is pushed out in the direction of the pressure pipe 11.

The special feature of the invention is the fact that the diaphragm working spaces 6 and the pump working spaces 6'' are arranged differently. In this case, the diaphragm working space 6, which is assigned to the center cylinder 2, is arranged as an axial extension of the center cylinder. The diaphragm working spaces 6 of the two other cylinders, on the other hand, are located at front sides of the cylinder block 3 which are situated opposite one another. In this manner, there is the possibility of arranging diaphragm working spaces 6 with a large cross-section and to arrange flat diaphragms 7 with very large diameters, specifically also in cases where the cylinders 2 only have a narrow distance from one another. This provides the possibility of using a crank mechanism for the pump as it is used for conventional pumps without any diaphragms and is manufactured on a comparatively large scale and therefore cost-effectively.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A diaphragm pump having several cylinders which are arranged in a row and which each form a stroke working space of a piston as well as having pump working spaces arranged in the same number which each may be closed off on the suction side by an inlet valve arrangement and, on the pressure side, by an outlet valve arrangement and are separated by a diaphragm from the stroke working space of the assigned piston or plunger, the work of the piston or plunger being transmissible to the diaphragm by a transmission fluid received in the stroke working space, wherein the cylinders are arranged at distances which are narrow in comparison to the cross-section of the pump working spaces, and the pump working spaces assigned to adjacent stroke working spaces are arranged on different sides of the row of cylinders or of a cylinder block receiving the cylinders.

2. A diaphragm pump according to claim 1, wherein, in the case of a three-cylinder pump, the pump working space assigned to the center cylinder is arranged as an extension of the center cylinder, and the pump working spaces assigned to the other cylinders are each arranged laterally of the cylinder axis.

3. A diaphragm pump according to claim 2, wherein the pump working spaces assigned to the other cylinders are each arranged as a lateral extension of the cylinder row.

4. A diaphragm pump according to claim 1, wherein the arrangement consists of essentially disk-shaped or plate-shaped flat diaphragms.

5. A diaphragm pump according to claim 2, wherein the arrangement consists of essentially disk-shaped or plate-shaped flat diaphragms.

6. A diaphragm pump according to claim 3, wherein the arrangement consists of essentially disk-shaped or plate-shaped flat diaphragms.

7. A diaphragm pump according to claim 2, wherein the pump working spaces assigned to the other cylinders are disposed at respective lateral sides of the cylinder block.

8. A diaphragm pump comprising:

a plurality of cylinders arranged in a row in a cylinder block, a plurality of movable pistons, one each of said pistons being axially slidably disposed in respective ones of said cylinders to form respective cylinder stroke working spaces, a plurality of movable diaphragms, one each of said diaphragms being disposed with one diaphragm side facing a respective one of said cylinder stroke working spaces and an opposite diaphragm side facing a pump working space, each of said pump working spaces being communicated with respective inlet valve and outlet valve arrangements, wherein work of the pistons is transmitted to the respective pump working spaces via the respective associated diaphragms, wherein the cylinders extend parallel to one another and at a spacing from one another which is smaller than a cross-sectional diameter of an associated diaphragm and corresponding pump working space, and wherein the pump working spaces associated with respective adjacent cylinders are oriented at different angles with respect to one another to thereby accommodate close spacing of the cylinders while utilizing diaphragms and pump working spaces with a substantially greater cross-sectional area than the cross-sectional area of respective ones of said cylinders.

9. A diaphragm pump according to claim 8, wherein, in the case of a three-cylinder pump, the pump working space assigned to the center cylinder is arranged as an extension of the center cylinder, and the pump working spaces assigned to the other cylinders are each assigned laterally of the cylinder axis.

10. A diaphragm pump according to claim 8, wherein the arrangement consists of essentially disk-shaped or plate-shaped flat diaphragms.

11. A diaphragm pump according to claim 9, wherein the arrangement consists of essentially disk-shaped of plate-shaped flat diaphragms.

* * * * *